US010212985B1

(12) United States Patent
Yang

(10) Patent No.: US 10,212,985 B1
(45) Date of Patent: Feb. 26, 2019

(54) CAP AND SWEATBAND HAVING COOLING AND SWEAT WICKING FEATURES

(71) Applicant: Po Lung Yang, Taichung (TW)

(72) Inventor: Po Lung Yang, Taichung (TW)

(73) Assignee: HEADMOST INTERNATIONAL, INC., Ontario, CA (US)

( * ) Notice: Subject to any disclaimer, the term of this patent is extended or adjusted under 35 U.S.C. 154(b) by 315 days.

(21) Appl. No.: 15/148,342

(22) Filed: May 6, 2016

Related U.S. Application Data

(63) Continuation-in-part of application No. 14/209,782, filed on Mar. 13, 2014, now abandoned, which is a continuation-in-part of application No. 13/486,525, filed on Jun. 1, 2012, now abandoned.

(51) Int. Cl.
*A42C 5/02* (2006.01)
*A42B 1/22* (2006.01)
*A41D 20/00* (2006.01)

(52) U.S. Cl.
CPC ..... *A42C 5/02* (2013.01); *A41D 20/00* (2013.01); *A42B 1/22* (2013.01)

(58) Field of Classification Search
CPC .. A42C 5/02; A41D 20/00; A42B 1/22; A42B 1/069
USPC ..... 2/183, 181, 181.6
See application file for complete search history.

(56) References Cited

U.S. PATENT DOCUMENTS 792,533 A 6/1905 Miller
1,430,995 A 10/1922 Holman
1,478,961 A 12/1923 Holman
1,637,126 A 7/1927 Nelson
1,674,361 A 6/1928 Gstaider
2,051,714 A 8/1936 Huntington
2,067,231 A 1/1937 Clark
2,377,933 A 6/1945 Glass
2,696,618 A * 12/1954 Hoffman ..... A42C 5/02 2/175.1
2,820,226 A 1/1958 Topiel et al.
3,465,366 A 9/1969 Pincus et al.
3,499,851 A * 3/1970 Ligo ..... C08L 99/00 106/407
4,277,847 A * 7/1981 Florio ..... A61F 9/045 2/12
5,325,539 A * 7/1994 Kronenberger ..... A42B 1/22 2/183
5,428,843 A 7/1995 Clowers et al.
5,615,415 A 4/1997 Beckerman
5,628,065 A 5/1997 Austin
(Continued)

*Primary Examiner* — Alissa L Hoey
(74) *Attorney, Agent, or Firm* — Cislo & Thomas, LLP

(57) ABSTRACT

The present invention is an article of headwear that is conformable so as to accommodate a wide range of head sizes comprised of at least a crown portion that substantially covers the head of the wearer. Proximate the lowest edge of the crown portion is a sweatband or headband permanently affixed thereto that is stretchable in all directions, not just vertically and horizontally. The band is comprised of elastic threads woven into a diamond pattern so that it is capable of stretching and returning substantially to its original shape. In an alternative embodiment of the sweatband, the sweatband comprises a base layer of a flexible material with a plurality of longitudinal bands of fibers with wicking, odor reducing and antibacterial properties superimposed upon the base material of the sweatband.

20 Claims, 7 Drawing Sheets

(56) References Cited

U.S. PATENT DOCUMENTS 5,901,370 A * 5/1999 Linday ..... A41D 20/00 2/10
5,926,850 A 7/1999 Han
5,963,988 A * 10/1999 Jackson, Jr. ..... A41F 9/025 139/422
5,966,742 A 10/1999 Cunliffe
5,983,398 A 11/1999 Kronenberger
6,052,831 A 4/2000 Park
6,131,202 A 10/2000 Yan
6,163,888 A 12/2000 Park
6,199,213 B1 3/2001 Whang
6,347,410 B1 2/2002 Lee
6,493,880 B1 12/2002 Lo
6,499,144 B1 12/2002 Yan
6,502,245 B1 1/2003 McBride
6,546,563 B2 * 4/2003 Young ..... A42B 1/22 2/181
6,625,818 B2 9/2003 Putnam
7,048,013 B2 * 5/2006 Shannon ..... A41B 9/001 139/421
7,174,572 B1 2/2007 Diamond et al.
7,213,270 B2 5/2007 Lee
7,278,173 B2 10/2007 Turner
7,311,864 B2 * 12/2007 Chow ..... B29C 43/003 264/109
7,882,572 B2 2/2011 Wong
8,065,751 B2 11/2011 Chen
10,010,158 B2 * 7/2018 Do ..... A45F 3/14
2003/0126671 A1 7/2003 Park
2003/0177565 A1 9/2003 Park
2004/0199979 A1 10/2004 Ngan
2005/0028246 A1 2/2005 Lee
2005/0028247 A1 2/2005 Kim, II
2005/0066419 A1 * 3/2005 Lee ..... A42B 1/22 2/181
2005/0066420 A1 3/2005 Kim, II
2005/0223472 A1 * 10/2005 Shin ..... A42C 5/02 2/181
2005/0223474 A1 10/2005 Cho
2005/0235396 A1 * 10/2005 Lee ..... A42C 5/02 2/181
2006/0048273 A1 * 3/2006 Liao ..... A42B 1/22 2/181
2007/0022929 A1 * 2/2007 Wang ..... A41D 20/00 112/1
2007/0130669 A1 6/2007 Rogers
2007/0245456 A1 10/2007 Cho
2008/0022438 A1 * 1/2008 Schweers ..... A42B 1/069 2/181
2008/0216210 A1 9/2008 Tai
2008/0282448 A1 11/2008 Cho
2009/0077716 A1 3/2009 Farney
2009/0100655 A1 * 4/2009 Hung ..... D01F 1/10 28/100
2009/0183300 A1 7/2009 Cho
2010/0154101 A1 * 6/2010 Wang ..... A42C 5/02 2/181.2
2011/0191937 A1 8/2011 Wang
2011/0191939 A1 * 8/2011 Cheng ..... A42C 5/02 2/183
2011/0302695 A1 12/2011 Cho
2013/0318686 A1 12/2013 Yang
2014/0101811 A1 4/2014 Rogers
2015/0089715 A1 4/2015 Chan
2017/0002485 A1 * 1/2017 Huang ..... D03D 15/0027

* cited by examiner

CAP AND SWEATBAND HAVING COOLING AND SWEAT WICKING FEATURES

CROSS-REFERENCE TO RELATED APPLICATIONS

This continuation-in-part application claims the benefit of U.S. patent application Ser. No. 13/486,525 filed Jun. 1, 2012, entitled Headgear with Stretchable Headband and U.S. patent application Ser. No. 14/209,782 filed on Mar. 13, 2014, entitled Cap Having Unique Head Conforming Qualities, which applications are incorporated in their entirety by this reference.

Field of the Invention

The present invention relates to caps worn on the heat. In particular, it relates to adjustable caps that can be worn by users having heads of varying circumferences wherein unique features allow for ease of comfort, wherein one of the features is a hidden pocket formed by an interior pouch formed on the interior of the headband making up the cap. The present invention also relates generally to exercise accessory equipment and particularly to headbands worn by persons engaged in aerobic activities.

Background of the Invention—Caps

Headgear comes in various forms and sizes and inlude, but is not limited to, baseball caps, visors, hats with rims, beanies, etc. which are pre-skied to fit certain circumferences of heads or are adjustable so that they can be worn by persons having heads of various circumferences. Adjustable headgear may incorporate a mechanism that may be located at the back edge thereof proximate the nape of the neck of the wearer when it is worn which can adjust the size of the lower circumference of the portion that surrounds the head. For example, a common means of adjusting the size of a baseball type cap may employ a cut out area located proximate the nape o the neck and have variable lengths of overlapping plastic, or other material, straps on each side of the cut out area which may be attached to each other according to the desired circumference of the cap. One of the straps may include a plurality of protrusions and the corresponding other strap may include a plurality of corresponding holes. By snapping at least one of the protrusions into at least one of the apertures, the circumference of the cap may be adjusted. Alternatively, the cap may have a buckle at the back thereof which may be loosened or tightened depending on the desired circumference. Yet another alternative is the use of straps having hook and loops thereon located on opposite sides of the cutout area.

More recenty, caps may incorporate headbands or sweatbands that are circumferentially attached to the inside lower edge of the main interior portion of the cap. Some of these headbands are complicated to manufacture and are unnecessarily bulky. Some headbands also are not stretchable in all directions as one of more layers thereof restrict the expandability. Further, because some headbands are formed solely of cloth or other material, they deform over time and lose some stretchability. Some such headbands lack the ability to remove moisture from the brow of a wearer.

It is an object of the present invention to provide headgear that overcomes some or all of the construction and bulkiness of prior art headgear designs while still reducing the number of headgear necessary for a supplier to carry due to the adjustability of the headgear of the presentvention.

It is still another object of the invention to provide a conventional baseball cap design with are interior expansible or stretchable sweatband that has a unique physical structure which overcomes many of the prior art design disadvantages and which has a hidden pocket or pouch formed on the interior of the sweatband for receiving small objects such as a key. An alternative embodiment of the sweatband presents a multi-component sweatband having a combination of fiber types to enhance sweat wicking or removal action.

It is still a further object of the invention to provide a baseballcap having a sweatband structure using specifically designed thread stitching that allows for maximum adjustability conformability and case of comfort for the wearer thereof.

These and other objects of the invention will become apparent as the description proceeds herein. It one exemplary embodiment, it is contemplated that a stretchable or comfortable band, for a cap, be provided which utilizes stretchable threads or yarn that is woven in such a manner as to provide, in the at-rest or non-stretched state, that the threads that make up the band are woven diagonally as opposed to conventional rectangular weaving and wherein the intersecting woven threads form diamond-shaped figures. The diamond-shaped figures establish a better fit which does not cause pressure discomfort to the wearer of the cap and facilitates superior sweat absorbent features. Also, in one embodiment, an interior placed pocket or pouch is secured the interior of the sweatband which is open at the lateral sides thereof to receive small objects, such as paper currency or the like.

Background of the Invention—Sweatbands

With regard to sweatbands, the benefits of regular strenuous aerobic activities have been well documented and various aerobic sports have been taken up by a variety of Americans, Running, basketball, jazzercise, bicycling, hiking, and the like are but a few of the aerobic activities in which individuals regularly engage in order to establish and maintain a healthy lifestyle. A byproduct of strenuous aerobic exercise is that it generates significant perspiration.

It is well known that the region of maximum heat transfer of the human body is the head and scalp and when a perm is exercising, the perspiration that is formed in the head and scalp area will condense into droplets of perspiration. These droplets of perspiration will tend to run down over the face and into the eyes of the person exercising, thus causing irritation to the eyes and blurring vision. Both of these byproducts of the exercise routine can be annoying and when one is engaging in sports which require close tracking of balls in play such as tennis, racquetball, baseball and basketball, it can be dangerous to have blurred vision. To remedy this byproduct of strenuous aerobic exercise, many people wear sweatbands in the form of headbands about their forehead to try to soak up the perspiration and keeping it from running onto the face and into the eyes.

Prior art sweatbands, while effective to some degree, have proven to be deficient in other areas. Specifically, in the past, in order to get a sweatband that is sufficiently absorbent to hold a significant amount of perspiration generated during the course of an exercise routine sweatbands have been required to be so large and cumbersome that they in some ways interfere with the exercise routine. Smaller, thinner sweatbands which are better suited and more compatible with an exercise routine do not have sufficient absorption capacity to soak up all the perspiration that is generated during a vigorous workout. Therefore, there is room in the art for a sweatband that works differently from those of the prior art. Ideally, such a sweatband would wick perspiration from the surface of a wearer's skin, which would correspond to an inside surface of the sweatband, to an outside surface or fibers of the sweatband where the sweat could removed from the headband or sweatband by evaporative cooling.

SUMMARY OF THE PREFERRED EMBODIMENTS

The present invention cap is an article of headwear that is conformable so as to accommodate a wide range of head sizes. In a preferred embodiment of the present invention, an article of headgear or cap is comprised of at least a crown portion that substantially covers the head of the wearer. In some embodiments, the headgear also may have a substantially rigid curved visor portion extending from the front of the crown portion so as to shade all or part of the wearer's face. Proximate the lowest edge of the crown'portion is a sweatband permanently affixed thereto. In an embodiment of the present invention, the sweatband is comprised of elastic threads which are woven in an intersecting diagonal pattern so that it is more evenly stretchable in all directions. In an embodiment, the elastic is woven in an essentially uniform diamond patterned elongated band. In a preferred embodiment, the sweatband is attached to the crown portion of the headgear along the circumferential edge thereof. In all embodiments of the present invention, the ends of the sweatband may be attached together so as to make a complete circumference around the lowest edge of the crown portion of the cap and the abutting ends of the sweatband may be covered by a label so as to provide additional comfort and label placment. The label has open lateral sides to receive and hold objects therein.

Summary of an Alternative Sweetband and Embodiment

The present invention sweatband provides a sweat absorbing band that is constructed of a combination of elements. The innermost or base layer for the sweatband comprises polyester fabric having a longitudinal length that is capable of stretching both axially and transversely, which allows the sweatband to achieve a snug fit about a user's head. (Generally, throughout this application the terms sweatband and headband will be used interchangeably. It should be understood however, that a sweatband, in addition to be being a head band, could be a wrist band (popular with tennis players) or even an ankle band.) Sewn into the longitudinal length of the base layer of the sweatband are longtiudinal bands comprised of fibers having specific properties different from that of the material of the base layer.

The exemplary embodiment of the present invention sweatband is believed to be suitable for use as a headband for a variety of sport or exercise activities. The exemplary sweatband comprises six vertically stacked, longitudinal bands comprised of special fibers. The upper two bands of fibers are "wicking" bands which are made from relatively loosely spaced polyester yarn, called wicking yarn, where each strand of wicking yarn extends perpendicularly from the base layer in a FIG. 8 configuration. Along a cross-sectional width of each band of wicking yarn, the yarns are spaced in sets of 5 yarns per 4 mm of width. Between each longitudinal band, a gap width of 1 mm, also referred to as a valley, is maintained.

As discussed, each individual wicking yarn extends perpendicularly from the base layer. Experimentation has shown that a height for the wicking yarn of about 2.4 mm from the base layer to the top of the yarn to be well suited for wicking sweat from the base layer to the top of wicking yarn where convection cooling occurs.

In the exemplary embodiment, below the first two upper bands of wicking yarn, are two intermediate bands of "coffee" yarn. Coffee yarn is, as the name suggests, a type of yarn made from the residue of coffee, i.e. coffee grounds. Coffee yarn is believed to have odor reducing and antibacterial properties which makes it a useful material for use in sweat bands. The chemical composition and production process for producing coffee yarn is disclosed in U.S. Pat. No. 8,834,753 entitled "Process of Making Yarns with Coffee Residue," which issued on Sep. 16, 2014.

Similar to the wicking yarn, each strand of the coffee yarn extends perpendicularly from the polyester base in a FIG. 8 configuration. Along the cross-sectional width of each band of coffee yarns, the yarns are spaced in sets of 5 yarns per 4.5 mm of width with a 1 mm gap width between the next longitudinal band.

Similar to the wicking yarns, each individual coffee yarn extends perpendicularly from the polyester base layer. The inventor's experience has. suggested that a height for the coffee yarn of about 2.3 mm from the base layer to the top of the yarn to be well suited for making use of the yarn's anti-odor and anti-bacterial functions.

The final two rows of longitudinal wicking bands sewn into the base layer are identical in all respects to the first two rows of wicking bands described above.

The inventors of the sweatband of the present invention believe that the band operates substantially more efficiently than those of the prior art because during vigorous athletic activity it is believed that a pressure differential due to the heat and sweat production of vigorous exercise arises between the base of the band and the outermost fibers of the wicking and coffee bands. As will be discussed in more detail below, the pressure differential increases the wicking or sweat removal effect of the present invention sweatband.

The above and other features of invention will become more apparent from the following detailed description.

BRIEF DESCRIPTION OF THE DRAWINGS

A detailed description of the invention will be made with reference to the accompanying drawings wherein like numerals of reference depict like elements throughout and in which.

DETAILED DESCRIPTION OF THE PREFERRED EMBODIMENTS

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and utilizing the invention in connection with the illustrated embodiments. However, it is to be understood that other applications of the cap of the invention will be readily apparent to those of ordinary skill in the art.

In the following descriptions of the invention, terms such as "top", "bottom," first "end" and second "end", "horizontal", "longitudinal", and the like are used herein merely for ease of description and refer to the orientation of the components shown its the figures. Further, the figures herein are not drawn to scale and should be considered to present an illustration of various embodiments of the present invention. Some features of the invention may have been distorted or enlarged to facilitate an understanding of the invention.

Figure 1:
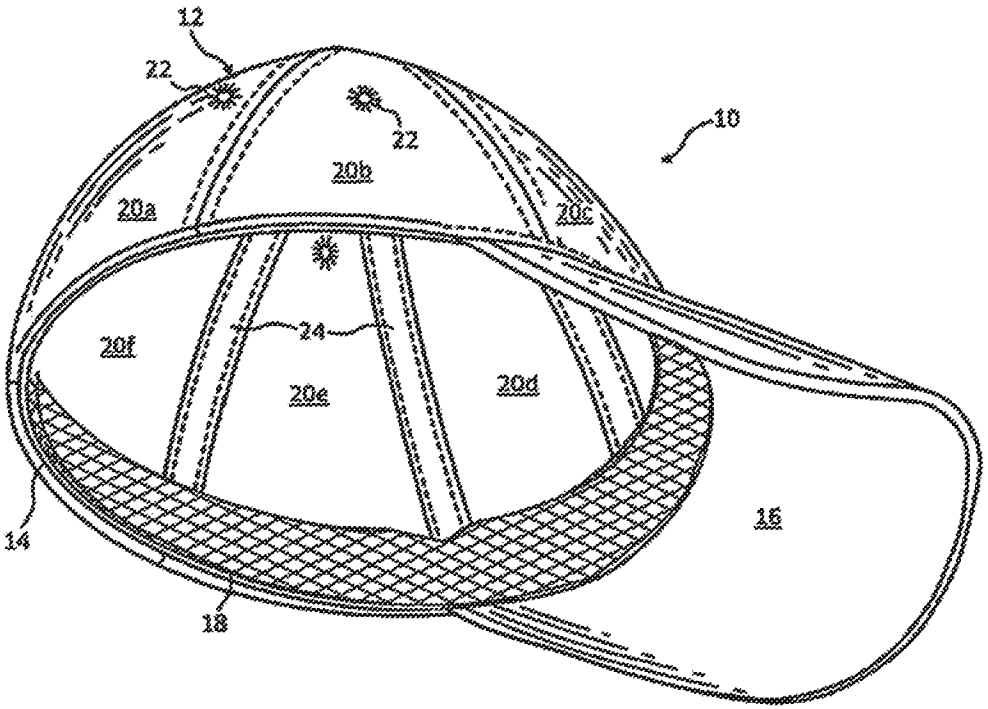
FIG. 1 is a perspective view of a cap in accordance with a preferred embodiment of the present invention.

Generally, the present invention may be briefly described as follows. Referring first to FIG. 1, a cap using the features and advantages of the present invention is shown. It should be understood that while a baseball cap is shown, the invention applies all headgear that has a crown portion covering either all or part of the scalp portion of the head. As such, the invenion applies to hats with visors, visors without total scalp covering, baseball caps, etc.

The baseball cap 10 comprises a crown portion 12 fabricated so that it substantially fits over the crown of a wearer's head. In a preferred embodiment the crown portion has a lower peripheral, circumferential edge 14 and a visor 16 extending from the front peripheral edge of the crown portion 12 so as to substantially shade the face and/or the eye area of the person wearing the cap 10 when the cap is properly placed upon the head.

A headband or sweatband 18 extends around the entire peripheral opening 14 of the crown portion 12 and is affixed to the crown portion 12 such that it is fully located within the crown portion 12 as shown in FIG. 1.

The crown portion 12 may be fabricated from several gores, which is a preferred embodiment of the present invention, comprising gores 20*a*, 20*b*, 20*c*, 20*e*, and 20*f* that are made of either synthetic or natural materials, such as polyesters, cotton, woven and non-woven material, felt, cotton with spandex, and other similar stretchable or non-stretchable materials. In addition, the gores may be made entirely or partially out of material that allows airflow to the scalp of the wearer. The number of gores 20 comprising the crown portion is dependent on the size of the final crown 12, the size of the gore, and the tensile strength of the material being used. In an embodiment, the gores contain one or more air holes 22 to allow the passage of air and moisture through the crown portion 12. In an embodiment, seam tape 24 or other material is used to cover the interior surfaces of the crown 12 where the gores 20 are affixed to each other to hide the seams created by attaching the gores to each other. In an embodiment of the present invention, a button 23 is placed upon the spot where the gores 20 converge at the top of the crown 12.

In the figures, the headband 18 of the present invention is shown. Headband 18 is comprised of an elongated woven band of elastic yarns wherein the yarns are woven in a diamond or diagonal pattern 19 as shown in the drawing. The diamond or diagonal pattern of the weave of the band allows it to be repeatedly stretched in a circumferential direction around the head of the wearer and repeatedly to substantially return to its original unstretched position, while still stretching as showing in FIG. 3 for conformability and comfort. The length of the woven band 18 is determined by the maximum size of the inner peripheral edge 14 of cap 10 such that in its fully extended position, the band it is not larger than the maximum size of the inner peripheral edge of cap 20. In one embodiment, the band is approximately 3.3 cm in width by 60 cm in length.

As those of ordinary skill in the art will recognize, the headband 18 is affixed to the peripheral edge of the crown portion of the cap and the peripheral edge of the visor 16 of the cap as shown in FIG. 1 by sewing. It should be noted that other methods of securing the headband 18 to the crown portion 12 and to the visor 16 are considered to be within the scope of the present invention. Also when the sweatband or headband is affixed to the peripheral edge 14 of crown 12, the ends 42, 44 of the headband 18 are secured together and may be hidden or overlaid by label 48 so as to prevent binding or discomfort caused by the seam. In a preferred embodiment, the seam is located at the base of the head proximate the neck of the wearer.

In one embodiment, the label 48 is constructed so as to form a pocket 47 of a size to accommodate the insertion of a human finger wherein secret retention of a monetary bill or other item may be secretly stored.

The pocket 47 may also be used as a means of hanging the cap 10 on a hook or other securing means.

Figure 3:
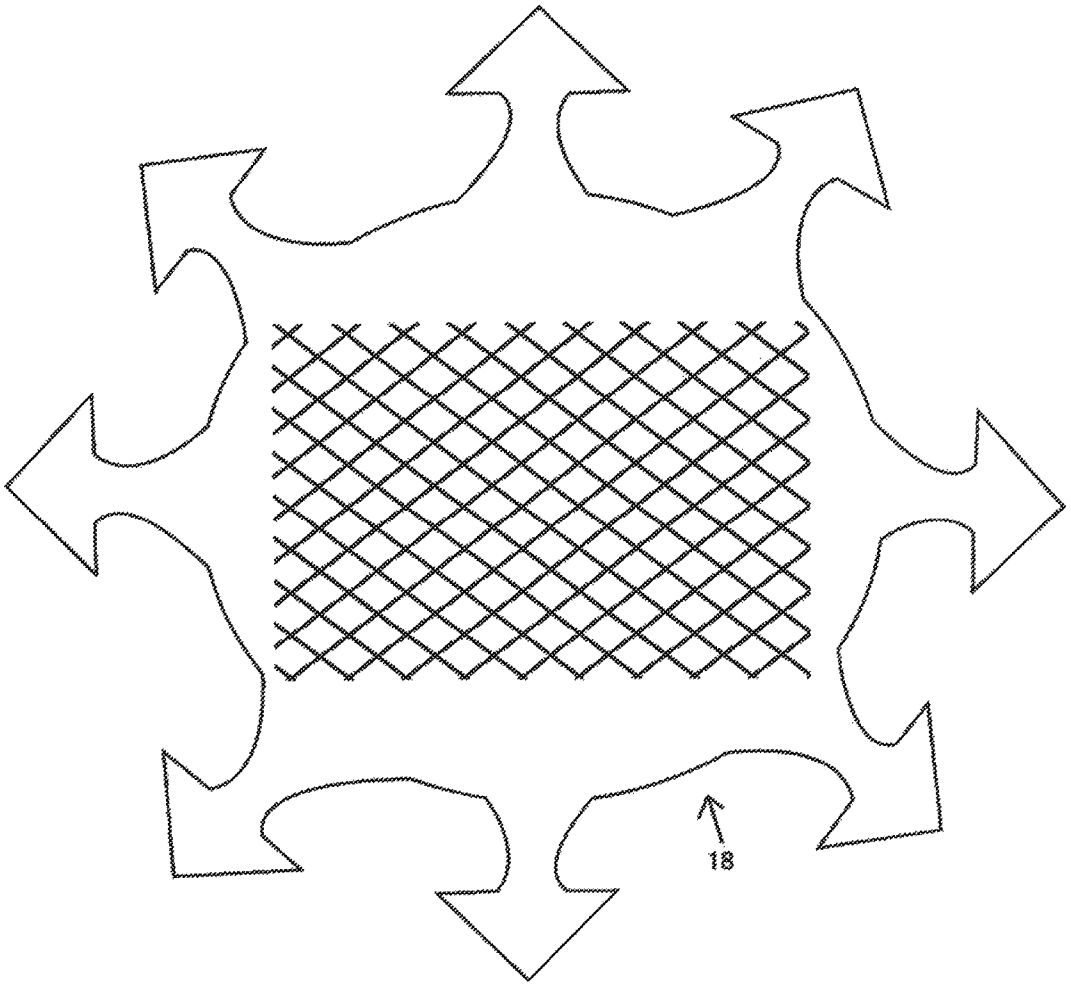
FIG. 3 is a schematic, enlarged view of the embodiment of the diamond woven sweatband of FIG. 2 illustrating how, in stretched of conforming configuration, the sweatband stretches in a plurality of directions.
Figure 2:
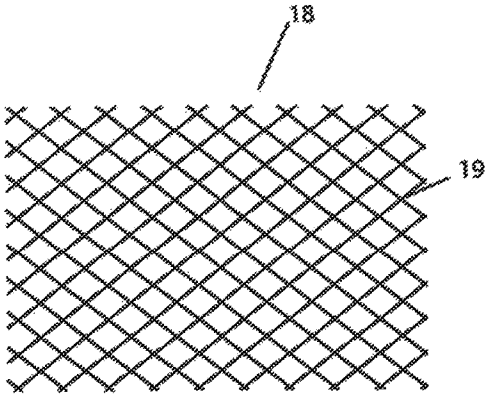
FIG. 2 is a schematic, exploded view of a portion of one embodimet of the sweatband of the invention illustrating the diamond configured weave pattern.
Figure 4:
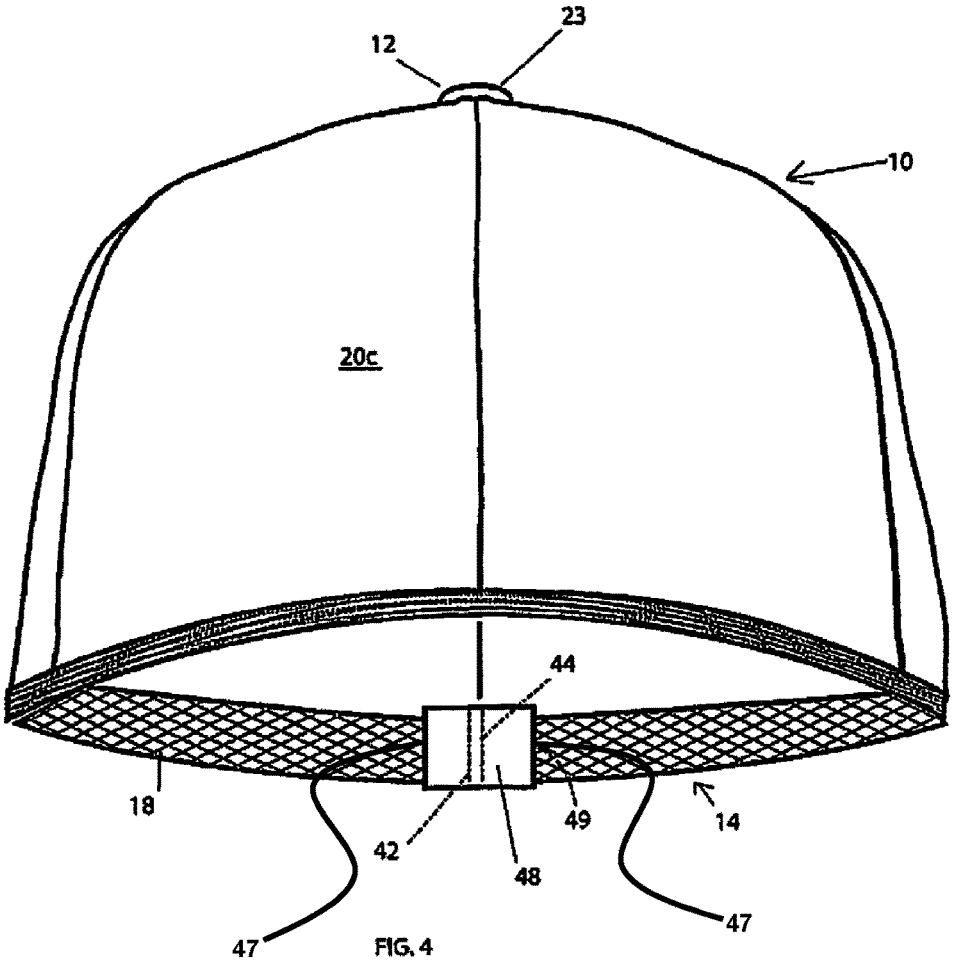
FIG. 4 is a cross sectioned view of a cap of the invention illustrating the label affixed over the abutting ends of the sweatband of a cap.
Figure 5:
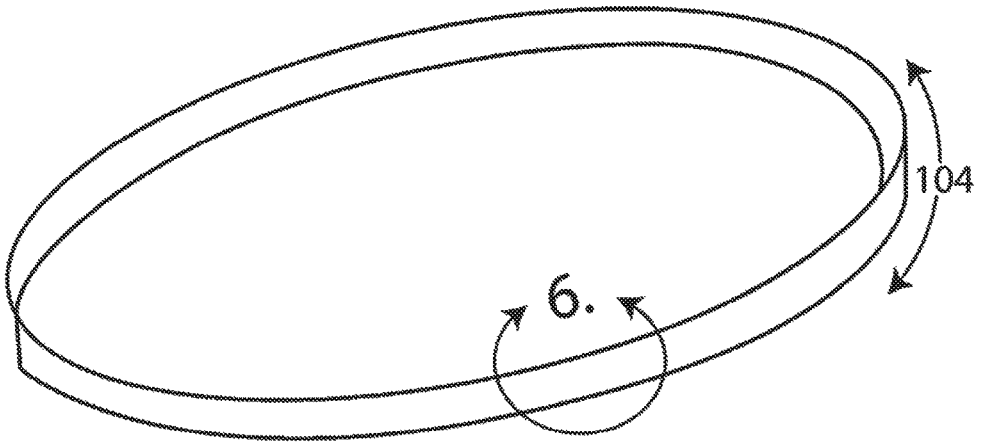
FIG. 5 is a perspective view of an additional exemplary embodiment of the sweatband of the present invention, comprised of longitudinal bands of "wicking" yarns and "coffee" yarns sewn or otherwise secured to a base layer.

The diamond or diagonal weave on the sweatband or headband 18 in the relaxed or unconfirmed state is capable of stretching in all directions as shown in FIG. 3 and thus can accommodate a wide range of head sizes in comfort.

Example

A baseball cap is fabricated of fabric gores with a stiff visor. A sweatband or headband of approximately 1.35 to 1.5 cm in width and about 16 to 25 cm in length, having been fabricated using threads that, are woven in an intersecting, diagonal pattern such that in the relaxed state, the threads form a plurality of diamonds in side-by-side configuration.

By of the example and not limitation, the material contents of the band (per 1'=23.9 g/yd.) is as follows: Vertical yarns: 13.7 g, 57%; Horizontal yarns: 3.6 g, 15%; Elastic materials (spandex): 6.6 g, 28%; Thickness of yarn: 300D Number of yarns needed: Vertical: 154 polyester yarns and 40 spandex yarns; Horizontal: 1 combined yarn with polyester and spandex as one yarn.

The weaving is specially designed to weave diagonally instead of traditional rectangular weaving.

Detailed Description of the Alternative Sweatband Embodiment

The alternative eembodiment of the sweatband of the present invention will now be described more fully hereinafter with reference to the accompanying drawings, in which preferred embodiments of the invention are shown. The invention may, however, may be embodied in many different forms and should not be construed as being limited to the embodiments set forth herein. Rather these embodiments are provided so that this disclosure will be thorough and complete, and will fully convey the scope of the invention to those skilled in the art, Like numbers refer to like elements throughout.

With reference to FIGS. 5-8, the present invention sweatband 100 provides a sweat absorbing band constructed of a combination of elements. The innermost or base layer 102 of the sweatband 100 comprises a longitudinal length 103 having an upper longitudinal edge 104 and a lower longitudinal edge 105 defining a cross-sectional width 136 therebetween. The base layer is capable of stretching both axially and transversely and will typically be made from a flexible polyester fabric which allows the sweatband to achieve a snug fit about a user's head. Sewn into the base layer 102 of the sweatband 100 are a plurality of longitudinal bands 106 comprised of fibers having specific properties different from that of the base layer 102.

Generally, throughout this application the terms sweatband and headband will be used interchangeably. It should be understood however, that a sweatband, in addition to be being a head band, could be a wrist band (popular with tennis players) or even an arm band or an ankle band, or other like band.

Figure 6:
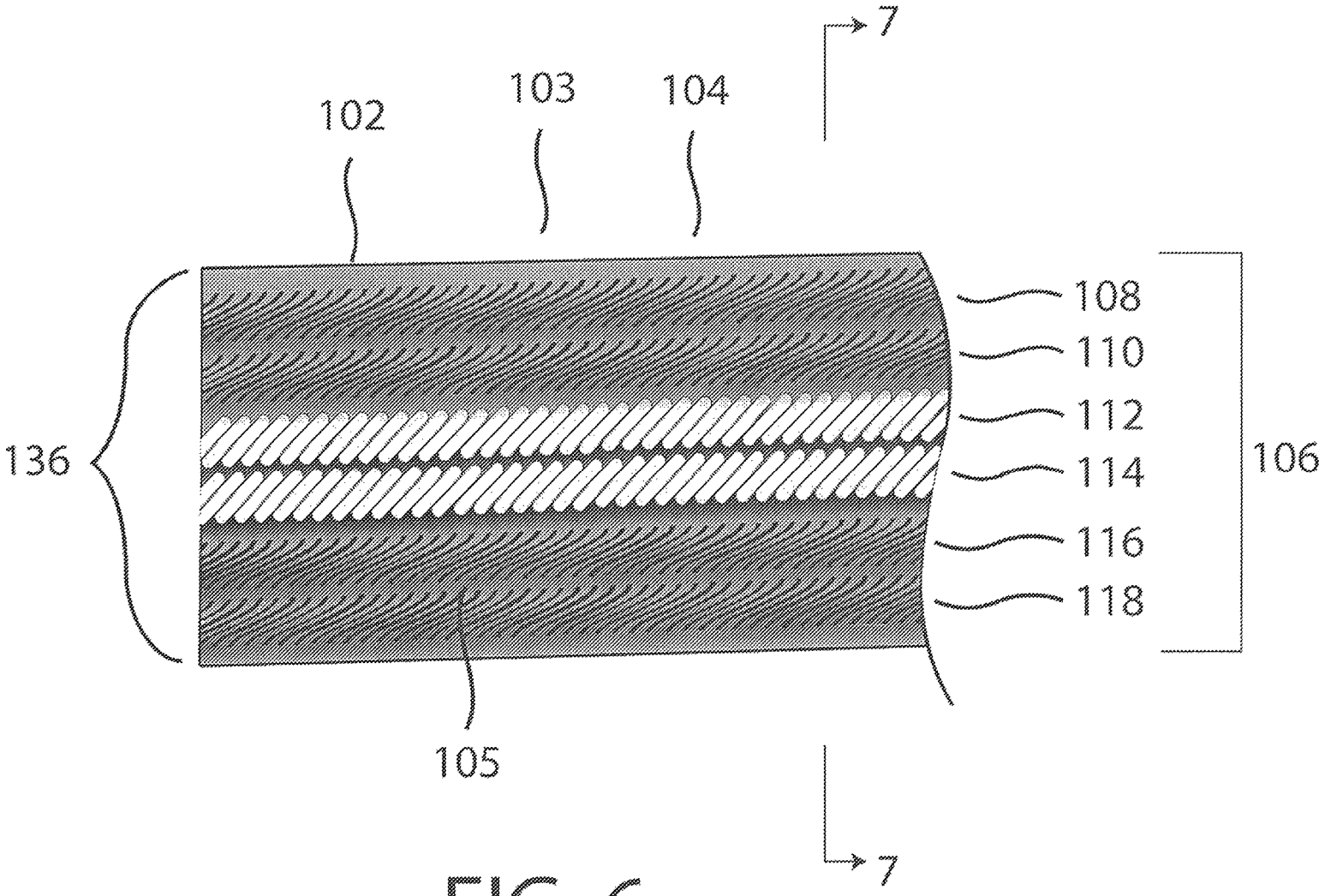
FIG. 6 is an enlarged view of a portion of the sweatbands of FIG. 5, showing an exemplary pattern of the longitudinal bands of wicking yarns and coffee yarns of the alternative embodiment of the sweatband of the present invention.

In the exemplary embodiment of the present invention sweatband 100, the plurality of longitudinal bands of fibers 106 comprises six specific bands of longitudinal fibers 108, 110, 112, 114, 116 and 118. (See FIG. 6.) The upper two longitudinal bands of fibers, from the perspective of FIG. 6, are bands 108 and 110. Longitudinal bands 108 and 110 are "wicking" bands which are made from relatively loosely spaced polyester yarn, call wicking yarn 120. (See FIG. 7.) Each strand of wicking yarn 120 is fabricated in a FIG. 8 configuration and each such strand of wicking yarn 120 extends perpendicularly from the base layer 102. Along the cross-sectional width 136 of the base layer 102, the yarns of the bands 108 and 110 of wicking yarn 120, are spaced in sets 126, wherein each set 126 comprises five (5) yarns per 4 mm of cross-sectional width with a gap width 132 of one (1) mm of width, between each set 126 of five (5) yarns.

The above pattern of one set 126 of wicking yarns comprising 5 yarns per 4 mm of cross-sectional width with a gap width 132 of 1 mm between the next set 126 of wicking yarns 120 is repeated between cross-sectional lengths of wicking yarn bands.

As will be discussed below, the spacing of sets 126 of wicking yarns and of sets 128 of coffee yarns differs, but in all cases a gap width 132 of 1 mm with is maintained between each band (108, 110, 112, 114, 116 and 118) of wicking and/or coffee yarns.

As discussed each individual wicking yarn 120 extends perpendicularly from the polyester base layer 102. Experimentation has shown that a height 124 of about 2.4 mm for the wicking yarn 120 from the base layer 102 to the top of the yarn to be well suited for wicking sweat from the base layer 102 to the top of wicking yarn where convection cooling is believed to occur.

In the exemplary embodiment from the perspective of FIG. 6, below the first two upper bands 108 and 110 of wicking yarn, are two intermediate bands 112 and 114 of "coffee" yarn. Coffee yarn is, as the name suggests, a type of yarn made from the residue of coffee, i.e. coffee grounds. Coffee yarn is made by incorporating coffee residue into a polyester base material from which the yarn is drawn. Coffee yarn is believed to have odor reducing and antibacterial properties which makes it a useful material for use in sweatbands. Coffee yarn is available from the Magictex Apparel Corporation located in Taipei, Taiwan. The chemical composition and production process for producing coffee yarns is disclosed in U.S. Pat. No. 8,834,753 entitled "Process of Making Yarns with Coffee Residue," which issued to Hung, et al. on Sept. 16, 2014.

Figure 8:
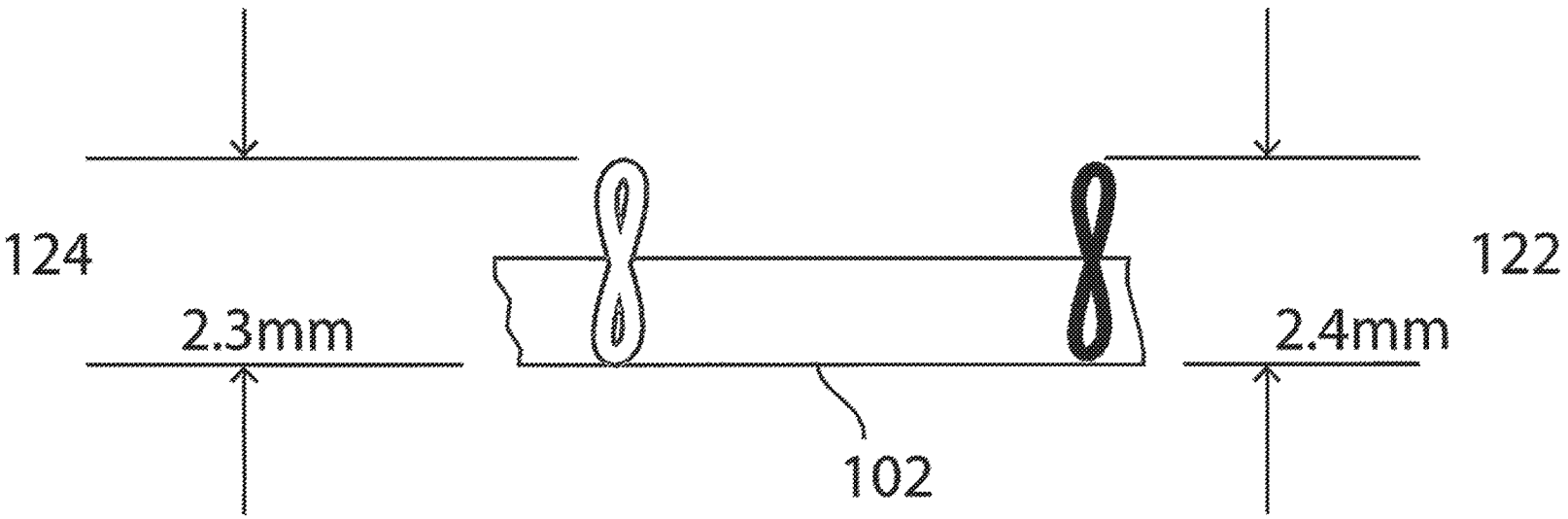
FIG. 8 is an enlarged view of a portion of the sweatband as shown in FIG. 7, depicting individual wicking and coffee yarns.

Similar to the wicking yarn 120, each strand of the coffee yarn 130 extends perpendicularly from the base layer 102 in a FIG. 8 configuration. Along the cross-sectional width 136 (see FIG. 6) of the base layer 102, each of the bands 112 and 114 of coffee yarn are spaced in sets 128 of five (5) yarns per 4.5 mm of cross-sectional width with a 1 mm gap width between each set of the sets 128 of five (5) yarns.

As shown in the exemplary embodiment, although the cross-sectional width of each set of wicking and coffee yarns differs, i.e. 4 mm for each set 126 of wicking yarns and 4.5 mm for each set 128 of coffee yarns, the gap width 132 between the adjacent bands of yarns is maintained at one (1) mm across the entire cross-sectional width 136 of the base layer 102, regardless of yarn type.

Similarly to the wicking yarns 120 , each individual coffee yarn 130 extends perpendicularly from the base layer 102. The inventor's experience has suggested that a height 124 (see FIG. 8) for the coffee yarn of about 2.3 mm from the base layer 102 to the top of the yarn to be well suited for making use of the yarn's anti-odor and anti-bacterial functions.

Figure 7:
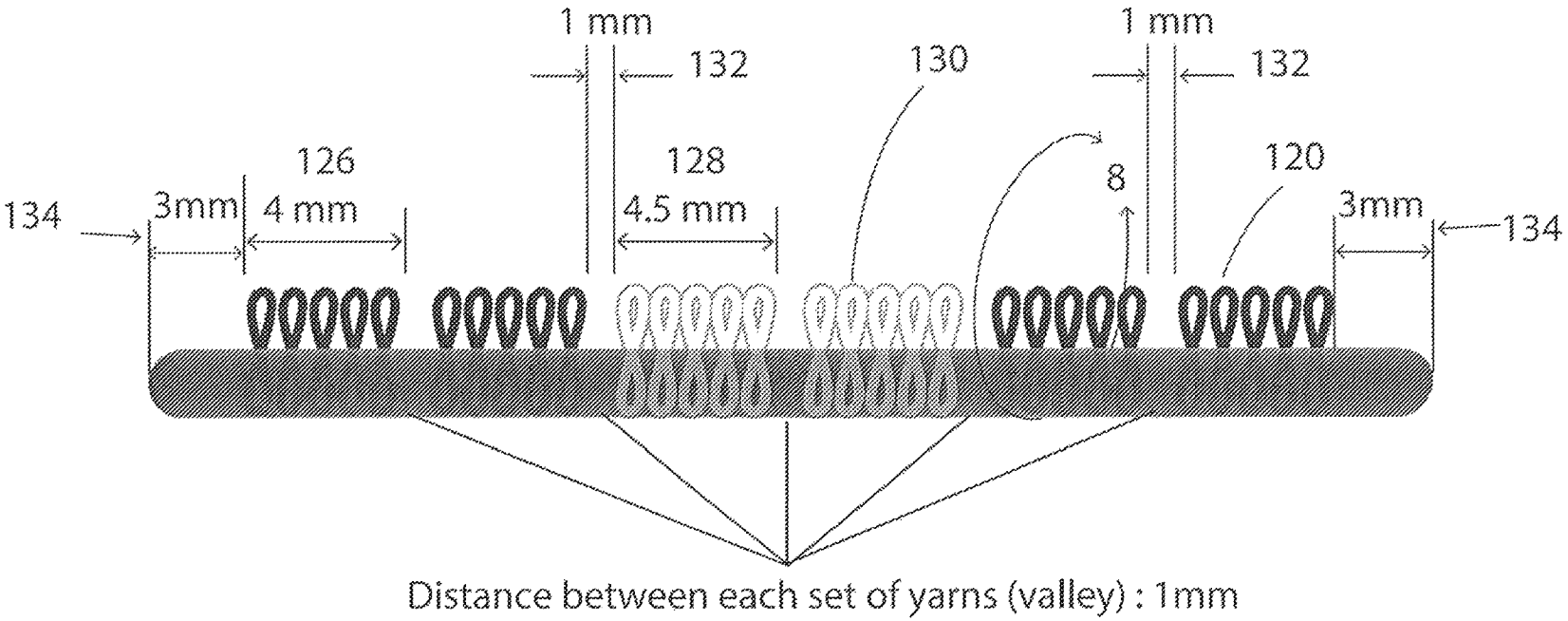
FIG. 7 is a cross-sectional view of the sweatband of the present invention taken along the line 7-7 of FIG. 6, showing the pattern and spacing of bands of wicking and coffee yarns across the width of the sweatband, as used in the present invention.

The bottom two rows, from the perspective of FIG. 6, of longitudinal wicking bands 116 and 118 sewn into the base layer 102 are identical in all respects to the first two rows 108 and 110 of wicking bands described above. With reference to FIG. 7, in the exemplary embodiment, an edge width 134 of about 3 mm is maintained between upper and lower longitudinal edges of the base layer 120 and edge of the nearest longitudinal band of wicking and/or coffee fiber.

In further alternative embodiments, the number and placement of the wicking and coffee bands of the sweatband may by changed depending upon the particular sport for which the sweatbands will be used and for the specific purpose that the sweatbands will be used. The two wicking bands, two coffee bands and two wicking bands construction of the exemplary embodiment described above is believed to be well suited for use as a headband. However, in a wrist band application, other arrangements such as one wicking band, one coffee band and another wicking band may also be suitable. Yet other applications may use other combinations of fiber bands.

The inventors of the sweatband of the present invention believe that the band operates substantially more efficiently than those of the prior art because during vigorous athletic activity it is believed that a pressure differential arises between the base of the sweatband and the outermost fibers of the wicking and coffee bands. A region of higher than ambient pressure is believed to be created at the base of the sweatband which is in contact with the wearer's skin. During vigorous workouts, a wearer's skin tends to get hot and produce sweat, the combination heat and sweat production is believed to locally increase pressure at the base of sweatband above that of the ambient conditions. As a result, sweat is wicked by the wicking and coffee fibers to the tops of the fibers which are believed to be at near ambient conditions, i.e. are slightly cooler and at slightly less pressure than the conditions at the base of the sweatband.

The foregoing detailed description and appended drawings are intended as a description of the presently preferred embodiment of the invention and are not intended to represent the only forms in which the present invention may be constructed and/or utilized, Those skilled in the art will understand that modifications and alternative embodiments of the present invention which do not depart from the spirit and scope of the foregoing specification and drawings, and of the claims appended below are possible and practical. It is intended that the claims cover all such modifications and alternative embodiments.

What is claimed is:

1. An expansible cap comprising:

a crown portion having a front and a back and a peripheral edge portion; an internal sweatband having first and second abutting ends circumscribing the interior of said expansible cap;

wherein the sweatband includes a base layer having a longitudinal length and an upper longitudinal edge and a lower longitudinal edge with a cross-sectional width, therebetween, the base layer defining an inner surface for contacting a user's skin and an outer surface at an opposing side of the inner surface;

a plurality of longitudinal bands having widths of fibrous material, attached to the base layer, each of the longitudinal bands including a plurality of yarn strands arranged consecutively along the cross-sectional width of the sweatband;

wherein the plurality of longitudinal bands are disposed between the upper longitudinal edge of the base layer and the lower longitudinal edge of the base layer, adjacent longitudinal bands being separated by a uniform gap width;

wherein the yarn strands of at least one of the plurality of longitudinal bands is composed of wicking fibers; and wherein the yarn strands of at least one of the plurality of longitudinal bands is composed of fibers containing coffee residue;

wherein the yarn strands of each of the longitudinal bands is disposed on the base layer to project beyond the outer surface.

2. The expansible cap of claim 1, wherein the base layer is composed of an elastic material.

3. The expansible cap of claim 1, wherein a margin of 3 mm is maintained between the upper longitudinal edge of the base layer and a first of the longitudinal bands.

4. The expansible cap of claim 1, wherein a margin of 3 mm is maintained between the lower longitudinal edge of the base layer and a last of the longitudinal bands.

5. The expansible cap of claim 1, wherein the at least one of the plurality of longitudinal bands having yarn strands composed of wicking fibers has a cross-sectional width of 4 mm with about five (5) yarns of wicking fibers thereacross.

6. The expansible cap of claim 1, wherein the at least one of the plurality of longitudinal bands having yarn strands composed of fibers containing coffee residue has a cross-sectional width of 4.5 mm with about five (5) yarns of fibers containing coffee residue.

7. The expansible cap of claim 1, wherein the wicking fibers extend to a height of approximately 2.4 mm from the base layer, and the fibers containing coffee residue extend to a height of approximately 2.3 mm from the base layer.

8. The expansible cap of claim 1, wherein a gap width of 1 mm is maintained between each of the plurality of longitudinal bands, regardless of whether the yarn strands of the longitudinal bands are composed of wicking fibers or fibers containing coffee residue.

9. The expansible cap of claim 1, wherein the sweatband includes a pocket on the interior of the sweatband, the pocket being configured to hold a monetary bill, house key or like sized item.

10. The expansible cap of claim 1, further comprising a visor having a front and a back peripheral edge, the back peripheral edge being affixed to the crown portion proximate the front peripheral edge, whereby the sweatband is also affixed to the portion of the visor proximate the back peripheral edge of the visor where the crown portion is attached to the visor.

11. The expansible cap of claim 1, wherein each of the yarn strands composed of wicking fibers forms a FIG. 8 configuration extending out from the base layer.

12. The expansible cap of claim 1, wherein each of the yarn strands composed of fibers containing coffee residue forms a FIG. 8 configuration extending out from the base layer.

13. The expansible cap of claim 1, wherein the yarn strands of each of the longitudinal bands are angled relative to the cross-sectional width of the sweatband.

14. The expansible cap of claim 1, wherein at least one of the longitudinal bands having yarn strands composed of wicking fibers has a first cross-sectional width and at least one of the longitudinal bands having yarn strands composed of fibers containing coffee residue has a second cross-sectional width, the first and second cross-sectional width being unequal.

15. The expansible cap of claim 1, wherein the yarn strands composed of wicking fibers have a first height from the base layer and the yarn strands composed of fibers containing coffee residue fibers have a second height from the base layer, the first and second heights being unequal.

16. An expansible cap comprising:

a crown portion having a front and a back and a peripheral edge portion; an internal sweatband having first and second abutting ends circumscribing the interior of said expansible cap;

wherein the sweatband includes a base layer having a longitudinal length and an upper longitudinal edge and a lower longitudinal edge with a cross-sectional width, therebetween;

a plurality of longitudinal bands having widths of fibrous material, attached to the base layer;

wherein the plurality of longitudinal bands are disposed between the upper longitudinal edge of the base layer and the lower longitudinal edge of the base layer;

wherein the yarn strands of at least one of the plurality of longitudinal bands is composed of wicking fibers;

wherein the yarn strands of at least one of the plurality of longitudinal bands is composed of fibers containing coffee residue; and wherein at least one of the of longitudinal bands having yarn strands composed of wicking fibers has a cross-sectional width of 4 mm with five (5) yarn strands of wicking fiber thereacross; and wherein at least one of the longitudinal bands having yarn strands composed of fibers containing coffee residue has a cross-sectional width of 4.5 mm with five (5) yarn strands of fibers containing coffee residue thereacross; and, wherein the yard strands composed of wicking fibers and the yard strands composed of fibers containing coffee residue are perpendicularly directed relative to the base layer; and, wherein the height of the wicking fibers from the base layer is about 2.4 mm and the height of the fibers containing coffee residue are about 2.3 mm from the base layer.

17. The expansible cap of claim 16, wherein each of the yarn strands composed of wicking fibers forms a FIG. 8 configuration extending out from the base layer.

18. The expansible cap of claim 16, wherein each of the yarn strands composed of fibers containing coffee residue forms a FIG. 8 configuration extending out from the base layer.

19. The expansible cap of claim 16, wherein the yarn strands of each of the longitudinal bands are angled relative to the cross-sectional width of the sweatband.

20. The expansible cap of claim 16, wherein the base layer defines an inner surface for contacting a user's skin and an outer surface at an opposing side of the inner surface, the yarn strands of each of the longitudinal bands being disposed on the base layer to project beyond the outer surface.

* * * * *